US009131819B2

(12) United States Patent
Jonsson

(10) Patent No.: US 9,131,819 B2
(45) Date of Patent: Sep. 15, 2015

(54) VACUUM CLEANER

(75) Inventor: Stefan Jonsson, Stockholm (SE)

(73) Assignee: Aktiebolaget Electrolux (SE)

( * ) Notice: Subject to any disclaimer, the term of this patent is extended or adjusted under 35 U.S.C. 154(b) by 659 days.

(21) Appl. No.: 13/127,835

(22) PCT Filed: Oct. 28, 2009

(86) PCT No.: PCT/EP2009/007706

§ 371 (c)(1),
(2), (4) Date: Aug. 2, 2011

(87) PCT Pub. No.: WO2010/051930

PCT Pub. Date: May 14, 2010

(65) Prior Publication Data

US 2011/0277272 A1 Nov. 17, 2011

Related U.S. Application Data

(60) Provisional application No. 61/118,201, filed on Nov. 26, 2008.

(30) Foreign Application Priority Data

Nov. 5, 2008 (SE) ..... 0802345

(51) Int. Cl.
*A47L 9/22* (2006.01)
*A47L 9/28* (2006.01)
(Continued)

(52) U.S. Cl.
CPC ..... *A47L 9/22* (2013.01); *A47L 7/0042* (2013.01); *A47L 9/0081* (2013.01)

(58) Field of Classification Search
CPC ..... A47L 9/0081; A47L 9/22; A47L 7/0042
USPC ..... 15/412
See application file for complete search history.

(56) References Cited

U.S. PATENT DOCUMENTS 4,617,034 A * 10/1986 Ikezaki et al. ..... 96/382
4,746,092 A * 5/1988 Hayashi et al. ..... 248/638
(Continued)

FOREIGN PATENT DOCUMENTS

DE 198 02 345 5/1999
EP 1 867 265 12/2007
(Continued)

*Primary Examiner* — Bryan R Muller
(74) *Attorney, Agent, or Firm* — RatnerPrestia

(57) ABSTRACT

The present invention relates to a vacuum cleaner having a motor housing provided with an inlet and an outlet, a motor and suction fan unit, which is arranged in the motor housing and which is arranged to create a suction flow in through the inlet of the housing, through the motor and suction fan unit and out through the outlet of the motor housing. The vacuum cleaner further comprise holding means for holding the motor and suction fan unit at the motor housing and sealing means arranged to guide the suction flow from the inlet of the motor housing and into the motor and suction fan unit in a sealingly manner. The holding means is arranged to prevent propagation of vibrations originated in the motor and suction fan unit from the motor housing by the holding means responding resiliently to forces from the motor and suction fan unit, and the holding means carries the motor and suction fan unit at the housing. The sealing means is arranged to prevent propagation of vibrations originated in the motor and suction fan unit from the motor housing by yielding to forces from the motor and suction fan unit.

17 Claims, 5 Drawing Sheets

(51) Int. Cl.
*A47L 7/00* (2006.01)
*A47L 9/00* (2006.01)

(56) References Cited

U.S. PATENT DOCUMENTS 5,513,417 A * 5/1996 Kim et al. ..... 15/326
5,813,085 A * 9/1998 Fritz et al. ..... 15/314

FOREIGN PATENT DOCUMENTS

JP 05 084194 4/1993
JP 05084194 A * 4/1993
WO WO 2009/066648 5/2009

* cited by examiner

VACUUM CLEANER

This application is a U.S. National Phase application of PCT International Application No. PCT/EP2009/007706, filed Oct. 28, 2009 and claims priority to Swedish Patent Application No. 0802345-9, filed Nov. 5, 2008, and the benefit of U.S. Provisional Application No. 61/118,201, filed Nov. 26, 2008.

TECHNICAL FIELD OF THE INVENTION

The present intention relates to a vacuum cleaner comprising a motor housing provided with an inlet and an outlet. Said vacuum cleaner further comprising a motor and suction fan unit, which is arranged in the motor housing and which is arranged to create a suction flow in through the inlet of the housing, through the motor and suction fan unit and out through the outlet of the motor housing.

BACKGROUND ART

Vacuum cleaners of today are most commonly equipped with a motor and suction fan unit arranged inside a vacuum cleaner casing. The motor and suction fan is normally enclosed in a casing, which is arranged in a motor housing. The motor housing, in turn, is surrounded by an appealingly designed vacuum cleaner casing. When the user pushes a start-button on the vacuum cleaner, the motor and suction fan unit is turned on and starts to create a suction flow through the vacuum cleaner.

A problem with the present vacuum cleaners is the disturbing noise during operation of the vacuum cleaner. There are many noise sources in a vacuum cleaner, such as the suction flow itself and the motor sound. However, some of the noise originates from vibrations transferred from the motor and suction fan unit to the motor housing and the vacuum cleaner casing of the vacuum cleaner.

It is known to reduce noise from motor vibrations in vacuum cleaners by mounting the motor and suction fan unit to the motor housing wall via a polymeric ring. The ring is arranged to seal between a dust collection space and the inlet of a motor and suction fan unit, and to support the motor and suction fan unit while simultaneously protect the housing from the vibrations originating in the motor and suction fan unit.

However, although some noise reduction can be achieved with these prior art vacuum cleaners, it is still desirable to improve their noise level even more.

SUMMARY OF THE INVENTION

It is therefore an object of the present invention to provide a vacuum cleaner that alleviate at least some of the above mentioned problems.

This object is achieved by a vacuum cleaner having the features defined in the appended claim 1. Preferred embodiments thereof are defined in the dependent claims 2-13.

Thus, the invention is based on the insight that the requests/demands on said polymeric ring of being able to seal and to limit propagation of vibrations are contradictory. If the ring is made less rigid to provide more efficient damping, this results in poorer sealing properties, and correspondingly, if the ring is made more rigid to provide more efficient sealing, this results in less efficient limitation of vibration propagation. Based on this insight, a solution to redesign the above mentioned sealing and supporting polymeric ring from being a component sealing the suction flow, holding the motor and suction fan unit and damping vibrations into holding means and sealing means, which are optimized in different functions. Due to this design, the holding means can be designed to hold the motor and suction fan unit and to damp vibrations independently of the design of the sealing means, and the sealing means can be designed to seal independently of the design of the holding means. The sealing means can be designed to seal while not transfer any forces or vibration to the motor housing. Therefore the sealing and holding can be more efficient in preventing propagation of vibrations than previous designs, and an efficient prevention of vibration propagation implies a lower sound level. The frequently occurring penetrating tone of the motor and suction fan unit, often perceived as annoying, can be reduced. Thus, a vacuum cleaner of the present invention provides a simple construction of a more silent vacuum cleaner.

According to the present invention, there is provided a vacuum cleaner comprising a motor housing provided with an inlet and an outlet, a motor and suction fan unit, which is arranged in the motor housing and which is arranged to create a suction flow in through the inlet of the housing, through the motor and suction fan unit and out through the outlet of the motor housing. The vacuum cleaner further comprise holding means for holding the motor and suction fan unit at the motor housing, and sealing means arranged to seal between the inlet of the motor housing and the motor and suction fan unit to guide the suction flow from the inlet of the motor housing and into the motor and suction fan unit. The holding means is arranged to prevent propagation of vibrations originated in the motor and suction fan unit to the motor housing by the holding means responding resiliently to forces from the motor and suction fan unit, wherein the holding means carries the motor and suction fan unit at the housing. The sealing means is arranged to prevent propagation of vibrations originated in the motor and suction fan unit to the motor housing by yielding to forces from the motor and suction fan unit.

The expression "responding resiliently to forces" means an elastic or flexible response, whereby the shape and size of the holding means recover quickly when the force is removed. The expression "yielding to forces" means a giving way to forces, for example by a bending or a folding movement, whereby the recovering tendency of the sealing means when the force is removed is low or absent.

The vacuum cleaner can be any type of vacuum cleaner comprising a motor and suction fan unit arranged inside a casing, for example a canister type of vacuum cleaner, a central vacuum cleaner or an upright type of vacuum cleaner. The motor and suction fan unit is normally arranged to create a suction flow of air. The vacuum cleaner can be provided with a traditional filter bag for dust collection or can be provided with a cyclone filter or a cyclone separator.

The motor and suction fan unit can be enclosed in a motor and suction fan unit casing. A motor housing encloses the motor and suction fan unit, the motor and suction fan unit casing and the holding means. The motor housing is normally arranged inside a vacuum cleaner casing.

The vacuum cleaner of the present invention comprises holding means arranged to hold the motor and suction fan unit at the motor housing. The holding means is arranged to withstand the suction forces during vacuum cleaning and the gravity force of the motor and suction fan unit. The holding means is further arranged to respond resiliently to forces from the motor and suction fan unit, such as vibrations forces or twisting forces. The vibrations can therefore, at least to some extent, be isolated inside the motor housing, prevented from further propagation.

According to one embodiment of the invention there is provided a vacuum cleaner wherein the sealing means and the holding means are separate units. The sealing means and the holding means can be arranged in connection to each other or separate from each other. The sealing means can for example be connected to the holding means by a band or a beam. An advantage of holding and sealing means arranged as separate units is that the holding means and the sealing means can be manufactured in different materials. The holding means can also be placed independently of the position of the sealing means. However, it is also conceivable that the holding and sealing means area single component having differently optimized portions, i.e. a sealing portion and a holding portion.

The holding means can be designed to respond to vibrations with a dampening effect, for example by comprising a separate damper or by an internal damping factor in the material or construction of the holding means. For example, the holding means can comprise a hydraulic damper or a rubber damper. This is advantageous in that the vibrations of the motor and suction fan unit not only will be prevented from propagating to the motor housing, but also will be reduced or even eliminated.

The holding means can further comprise a resilient or damping cushion element, which is arranged between a motor and suction fan wall and a motor housing wall. The cushion element can be any suitable resilient and/or damping element, such as a pad, a porous pad or an air filled pad. The cushion element can be a ring-shaped component. The ring-shaped component can comprise load-carrying protrusions which can be evenly distributed. The holding means can for example be made of a polymer, a rubber, a thermoelastic polymer, a silicone, a polyurethane material or a polyurethane foam.

The holding means of the present invention can comprise at least one spring arranged between a motor and suction fan wall and a motor housing wall. The dimension of the spring can be adjusted to respond to vibrations from the motor and suction fan unit by not being completely compressed nor completely stretched out. The spring can further be dimensioned considering the risk of resonances. The spring can be arranged to respond resiliently to forces from the motor and suction fan unit. Several springs can be arranged, connecting the motor and suction fan unit to the motor housing. The spring can for example be a helical spring, a rubber spring or a gas spring.

The vacuum cleaner of the present invention further comprises sealing means, arranged to guide the suction flow into the motor and suction fan unit. According to one embodiment, the sealing means is arranged to be flexible and yield to forces in the flow direction while being rigid and resistant to compressive load in the radial direction. This construction prevents the transfer of vibrations from the motor and suction fan unit via the sealing means to the motor housing, while at the same time withstand the suction pressure on the inside and the compressive load on the outside of the sealing means. Hence, the sealing means can be arranged to avoid short-cut, feedback or an opposite directed flow.

The sealing means can comprise a tubular hollow space arranged between a motor housing and the motor and suction fan unit to guide the suction flow. The tubular hollow space can be circular whereby the tendency to collapse by the suction force is reduced. The sealing means can for example be made of a polymer, a rubber, a thermoelastic polymer, a silicone, a polyurethane material or a polyurethane foam.

The sealing means can comprise a bellows. The bellows is a flexible and extensible sealing arranged to yielding to forces from the motor and suction fan unit while being rigid and resistant to compressive load in the radial direction. The bellows is unable to carry the motor and suction fan unit at the housing wall, and is arranged such that vibrations of the motor and suction fan unit are prevented from being transmitted via the bellows to the motor housing.

According to another embodiment of the invention the motor and suction fan unit, during operation, can be carried by the holding means only. This is preferably for the prevention of vibration propagation, as all the vibration transmission from the motor and suction fan unit then is forced to transmit via the holding means, which is arranged to respond resiliently to vibrations and can comprise damping means.

According to another embodiment of the invention the sealing means is centrally arranged while the holding means is arranged at the periphery. The motor and suction fan unit can comprise a casing having a first wall with a central inlet, wherein the sealing means is arranged at the central inlet and extends to the motor housing inlet. The holding means can be arranged at an outermost end of the first wall of the motor and suction fan unit casing and be connected to the motor housing wall. This is advantageous as it is effective to damp vibrations as far out in the periphery of the motor and suction fan unit casing as possible, where the construction of the casing is more stiff or rigid.

According to another embodiment of the invention, the first wall of the motor and suction fan unit casing is a top wall during normal use of the vacuum cleaner, and the motor and suction fan unit is hanging in the holding means from the motor housing wall. The force of the suction flow can then lift the motor and suction fan unit from the bottom of the motor housing when the motor and suction fan unit is turned on. Thereby the number of connection points can be reduced to only comprise connection points on top of the motor and suction fan unit. Every connection point implies a risk of vibration transmission. A reduced number of connection points can thus reduce the level of disturbing noise.

DETAILED DESCRIPTION OF PREFERRED EMBODIMENTS OF THE INVENTION

Figure 1:
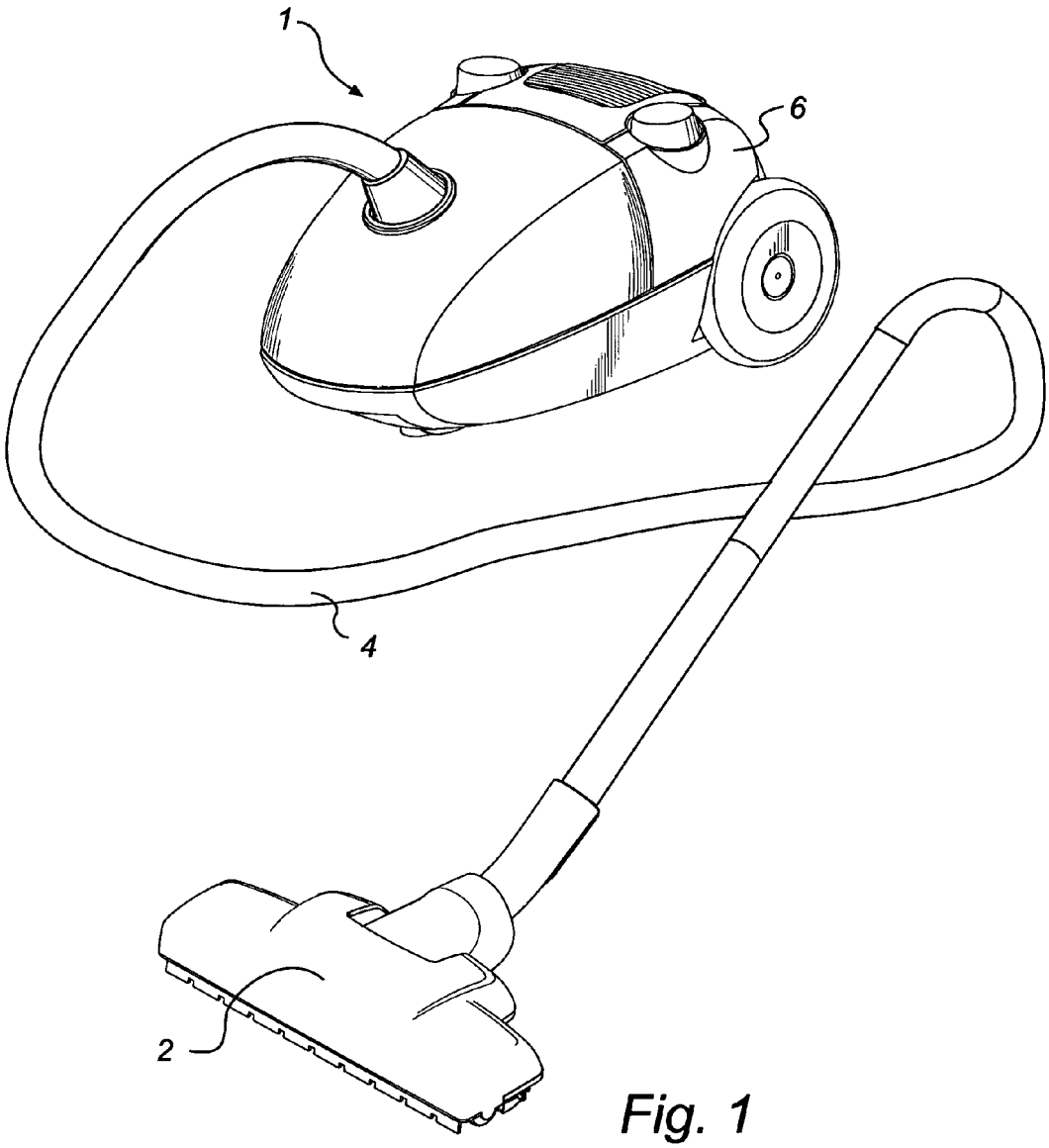
FIG. 1 is a perspective view of a vacuum cleaner according to a preferred embodiment of the invention.

FIG. 1 shows a perspective view of a vacuum cleaner 1 according to a preferred embodiment of the invention. The vacuum cleaner includes a nozzle 2, a tube 4 and a vacuum cleaner casing 6 wherein a dust collection space and a machinery unit with a motor and suction fan unit are embodied.

Figure 2:
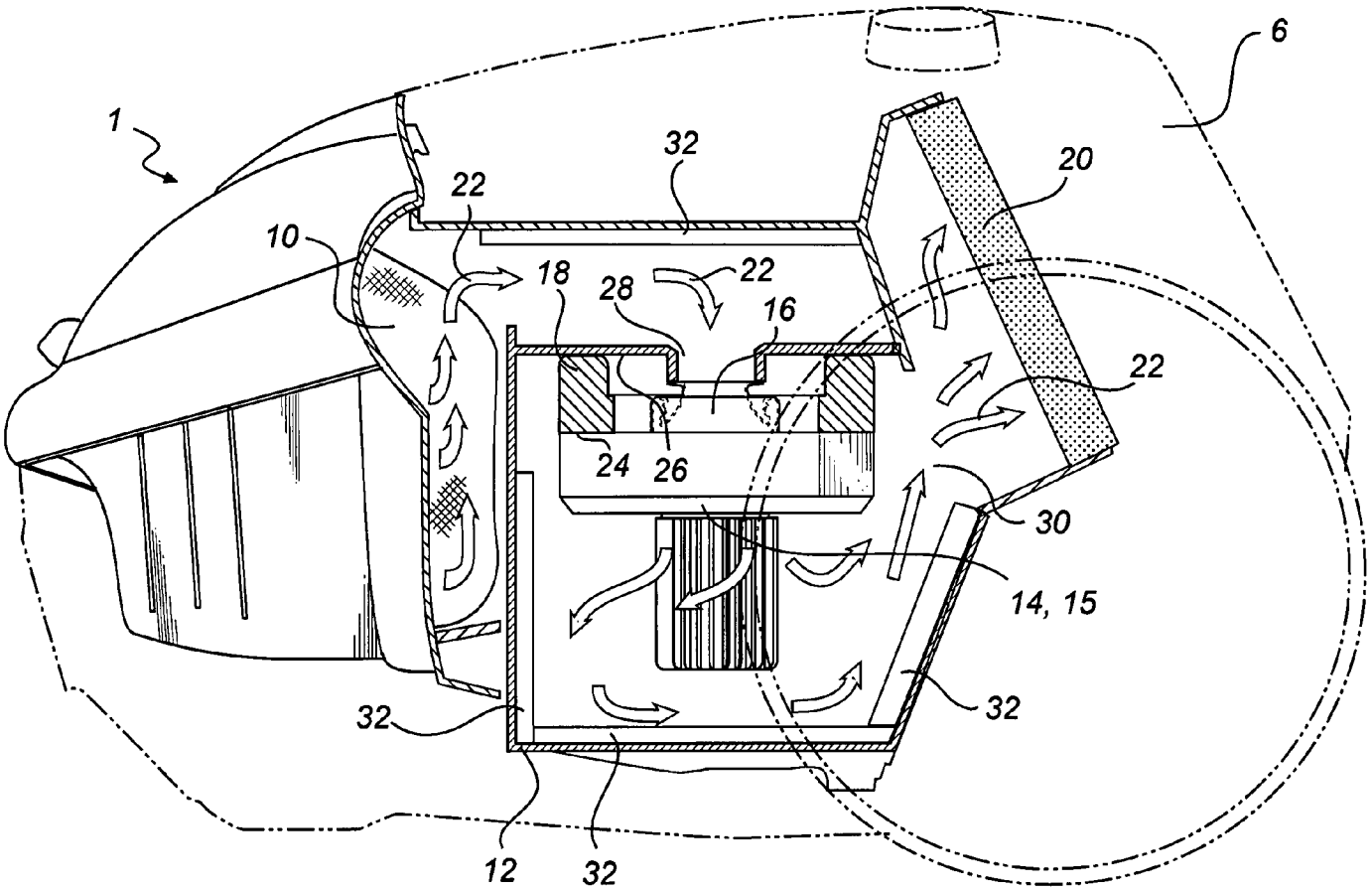
FIG. 2 is a sectional perspective view of a vacuum cleaner according to one preferred embodiment of the invention, showing the vacuum cleaner during operation.
Figure 3:
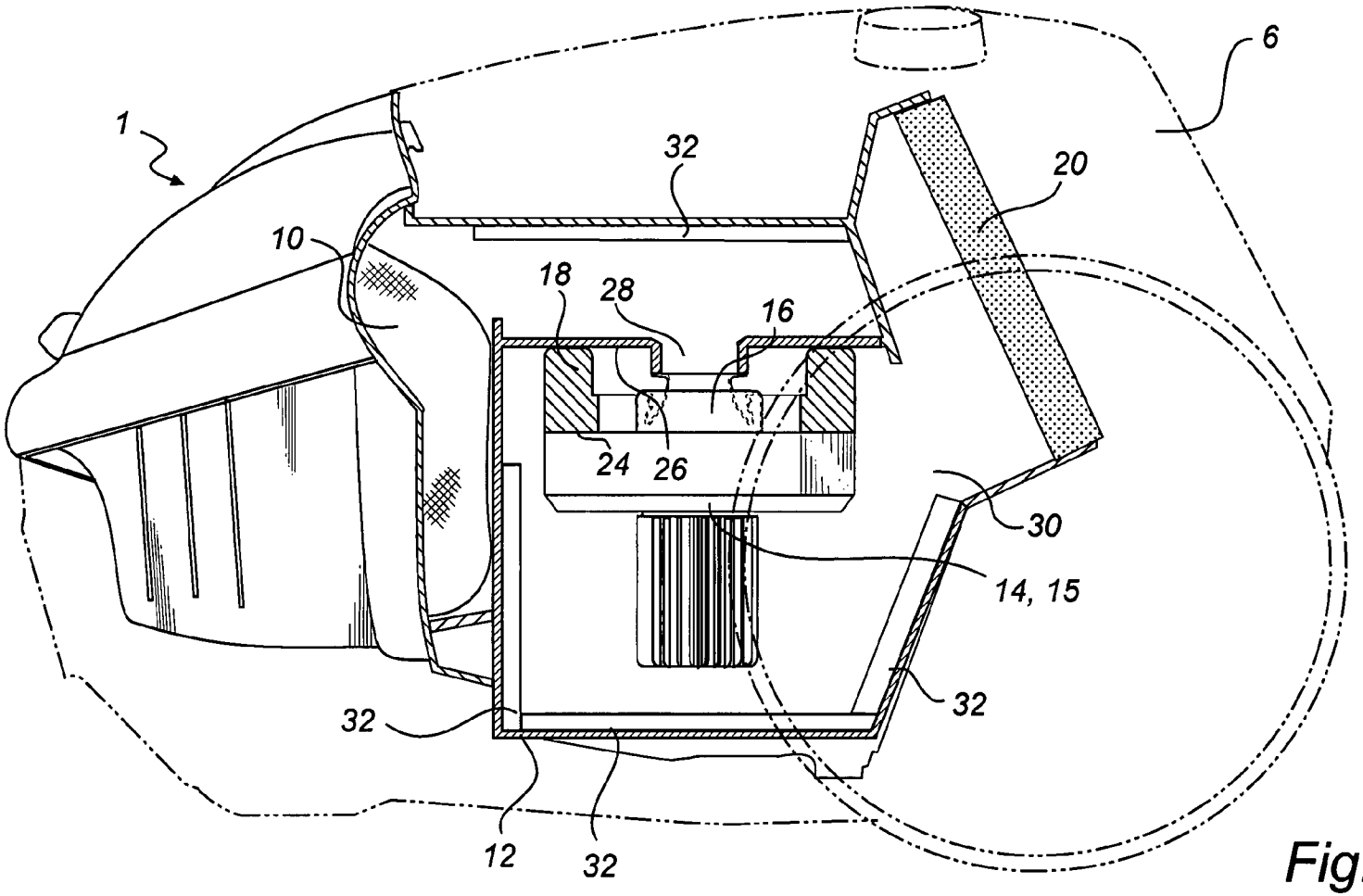
FIG. 3 is the view of FIG. 2, showing the turned off vacuum cleaner.

FIGS. 2 and 3 are sectional perspective views of a part of a vacuum cleaner 1 according to an embodiment of the invention. The vacuum cleaner 1 comprise a vacuum cleaner casing 6, a dust bag 10, a motor housing 12, a motor and suction fan unit 14 enclosed by a motor and suction fan unit casing 15, a sealing means in the form of a bellows 16, holding means 18 and a HEPA filter 20. In FIG. 2 the vacuum cleaner 1 is in operation and the path of the suction flow 22 inside the vacuum cleaner 1 is shown with arrows. In FIG. 3 the motor and suction fan unit 14 is turned off and is resting inside the motor housing 12.

The motor housing 12 is provided with an inlet 28 and an outlet 30. A bellows 16 is mounted at the inlet 28, connecting the inlet 28 of the motor housing 12 to a centrally arranged inlet of the motor and suction fan unit casing 15. The bellows 16 is sealing the suction flow 22 on the inside of the bellows 16 from the overpressure on its outside.

The motor and suction fan unit 14 is arranged inside a circular motor and suction fan unit casing 15, which is mounted to the motor housing 12 via the holding means 18. The holding means 18 are in the form of a cushion ring made of polyurethane, connecting the top wall 24 of the motor and suction fan unit casing 15 to the top wall 26 of the motor housing 12. The cushion ring is provided at the outermost periphery of the upper wall 24 of the motor and suction fan unit casing 15. The motor and suction fan unit casing 15 is only attached at its top wall 26, via the holding means 18 and the bellows 16, to the motor housing 12.

The inner walls of the motor housing 12 are covered with a sound absorbing layer 32. A HEPA filter 20 is arranged at an outlet of the vacuum cleaner casing 6.

The vacuum cleaner 1 according to the invention can be operated in the following way.

When the user turns on the vacuum cleaner 1, the motor and suction fan unit 14 is turned on whereby a suction flow 22 is created. The suction flow 22 withdraws for example dust from the area adjacent to the nozzle 2 of the vacuum cleaner 1. The suction flow 22 with the dust follows the tube 4 into the vacuum cleaner casing 6 where it enters the dust bag 10. The dust is collected in the dust bag 10, while the suction flow 22 passes through the walls of the dust bag 10. The suction flow 22 enters the motor and suction fan unit 14 via the inlet 28 of the motor housing 12 and the bellows 16. After passing the motor and suction fan unit 14, the suction flow 22 (actually turned into an exhaustion flow) is blown out of the vacuum cleaner casing 6 via the HEPA filter 20.

When the motor and suction fan unit 14 is running, vibrations are formed. The vibrations transmits to the holding means 18, which respond resiliently and with a dampening effect to the vibrations. This implies that the major part of the vibrations are damped, while only a minor part of the vibrations might transfer to the motor housing 12. The bellows 16 moves flexible with the vibrations without transmitting any additional forces or movements to the motor housing 12. The bellows 16 withstands the pressure differences between the suction force at its inside and the compressive force at its outside.

As the motor and suction fan unit 14 is running, the force created by the suction flow 22 is acting in the direction opposite to the gravitation, lifting the motor and suction fan unit 14, whereby the motor and suction fan unit 14 is pressed towards holding means 18 and the upper part of the motor housing 12. The motor and suction fan unit 14 is then hanging, only connected to the motor housing 12 via the holding means 18.

The sound absorbing layer 32 along the path of the suction flow, absorbs airborne noise.

When the vacuum cleaner 1 is turned off the motor and suction fan unit 14 stops vibrating and falls back into a resting.

Figure 4:
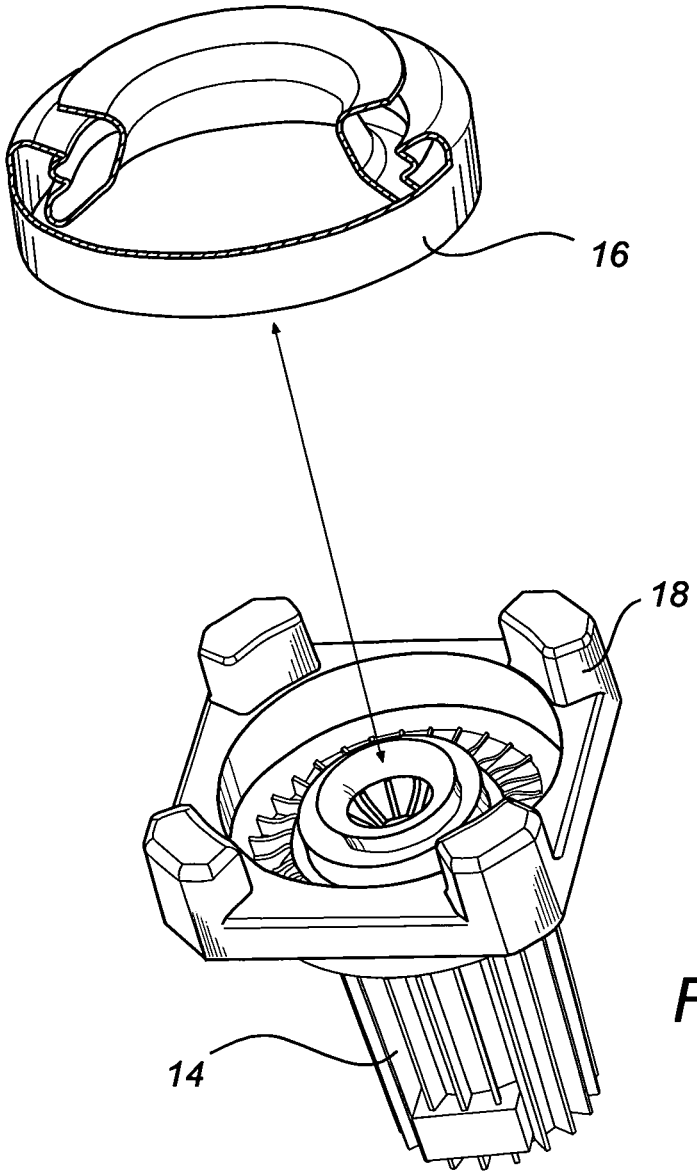
FIG. 4 is a close up of a part of a vacuum cleaner according to an embodiment of the invention.

In FIG. 4 the bellows 16 of a preferred embodiment of the present invention is shown in a close up, partly in cross section. Further, the holding means 18 are shown, here provided with four protruding cushions symmetrically arranged around the bellows 16. The holding means 18 are arranged on top of the motor and suction fan unit 14.

Figure 5:
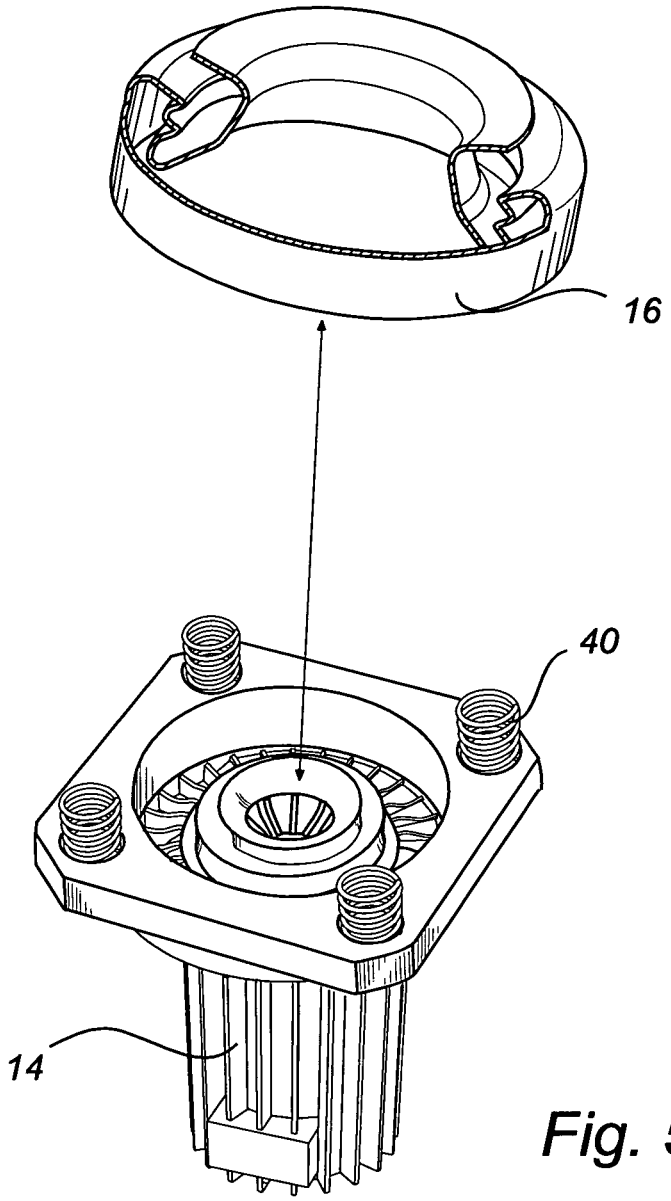
FIG. 5 is a close up of a part of a vacuum cleaner according to an embodiment of the invention.

FIG. 5 shows an alternative embodiment of the invention wherein the holding means 18 comprise four springs 40. The springs 40 are helical and are symmetrically arranged around the bellows 16. The springs 40 responds resiliently to the vibrations, without transferring any vibrations to the motor housing 12.

Although described with reference to a preferred embodiment of the present invention, it should be readily apparent to one of ordinary skill in the art that various changes and/or modifications can be made without departing from the scope of the invention as set forth in the accompanying claims. In general, the invention is only intended to be limited to the following claims.

The invention claimed is:

1. A vacuum cleaner having a motor housing provided with an inlet and an outlet, a motor and suction fan unit in the motor housing and arranged to create a suction flow in through the inlet of the motor housing, through the motor and suction fan unit and out through the outlet of the motor housing, holding means for holding the motor and suction fan unit in the motor housing, sealing means arranged to guide the suction flow from the inlet of the motor housing and into the motor and suction fan unit in a sealing manner, wherein:

the holding means is arranged to prevent propagation of vibrations originated in the motor and suction fan unit to the motor housing by the holding means responding resiliently to forces from the motor and suction fan unit;

the sealing means is arranged to prevent propagation of vibrations originated in the motor and suction fan unit to the motor housing by yielding to forces from the motor and suction fan unit;

the motor and suction fan unit is lifted and pressed toward the holding means and an upper part of the motor housing when the vacuum cleaner is turned on; and the sealing means comprises a first annular section sealed against the inlet of the motor housing, a first flexible tubular section extending from the first annular section towards the motor and suction fan unit and forming a hollow space for guiding the suction flow, a second flexible tubular section at least partially radially aligned outside the first flexible tubular section, a joining section connecting a lower end of the first flexible tubular section to a lower end of the second flexible tubular section, and a second annular section extending radially outward from an upper end of the second flexible tubular section.

2. A vacuum cleaner according to claim 1, wherein the holding means is arranged for holding the motor and suction fan unit at the motor housing independently of the sealing means, and the sealing means is arranged to guide the suction flow from the inlet of the motor housing and into the motor and suction fan unit independently of the holding means.

3. A vacuum cleaner according to claim 1, wherein the holding means and the sealing means are separate units.

4. A vacuum cleaner according to claim 1, wherein the sealing means comprises a bellows.

5. A vacuum cleaner according to claim 1, wherein the holding means comprises at least one resilient and/or damping cushion element, which is arranged between a wall of a motor and suction fan unit and a motor housing wall.

6. A vacuum cleaner according to claim 5, wherein the cushion element is a ring-shaped component.

7. A vacuum cleaner according to claim 5, wherein the cushion element is made of a polymer.

8. A vacuum cleaner according to claim 1, wherein the holding means comprises at least one spring, which is arranged between a motor and suction fan unit wall and a motor housing wall.

9. A vacuum cleaner according to claim 1, wherein:

the motor and suction fan unit comprises an upper motor and suction fan unit wall having a central inlet;

the motor housing has an upper motor housing wall facing the upper motor and suction fan unit wall;

the sealing means surrounds the central inlet and extends upwards from the upper motor and suction fan unit wall to seal against the upper motor housing wall at the motor housing inlet;

and the holding means extends upwards from the upper motor and suction fan unit wall to the upper motor housing wall.

10. A vacuum cleaner according to claim 1, wherein the motor and suction fan unit comprises a first top wall having a central inlet, the sealing means is arranged at the central inlet and extends to the motor housing inlet, wherein, during normal use of the vacuum cleaner, the motor and suction fan unit is hanging in the holding means from a motor housing wall.

11. A vacuum cleaner according to claim 1, wherein the motor and suction fan unit falls back into a resting position when the vacuum cleaner is turned off.

12. A vacuum cleaner according to claim 7, wherein the polymer is polyurethane.

13. A vacuum cleaner according to claim 1, wherein the motor and suction fan unit is enclosed in a casing.

14. A vacuum cleaner according to claim 1, wherein the sealing means further comprises a third tubular section located radially outside the second tubular section, an upper end of the third tubular section being joined to an outer perimeter of the second annular section.

15. A vacuum cleaner according to claim 1, wherein the second tubular section comprises a circumferential rib.

16. A vacuum cleaner according to claim 1, wherein the sealing means is formed separately from the holding means.

17. A vacuum cleaner according to claim 9, wherein the motor and suction fan unit is attached to the motor housing only by the sealing means and the holding means.

* * * * *